US006217501B1

(12) United States Patent
Simmons, Jr. et al.

(10) Patent No.: US 6,217,501 B1
(45) Date of Patent: Apr. 17, 2001

(54) CUSHIONING CONVERSION MACHINE

(75) Inventors: James A. Simmons, Jr., Painesville Township; Joseph James Harding, Mentor, both of OH (US)

(73) Assignee: Ranpak Corp., Painesville Township., OH (US)

( * ) Notice: Subject to any disclaimer, the term of this patent is extended or adjusted under 35 U.S.C. 154(b) by 332 days.

(21) Appl. No.: 08/672,856

(22) Filed: Jun. 28, 1996

(51) Int. Cl.[7] ..... B31F 1/10

(52) U.S. Cl. ..... 493/464; 493/12; 493/14; 493/29; 493/33; 493/967

(58) Field of Search ..... 493/464, 967, 493/9, 10, 12, 13, 17, 23, 28, 29, 33; 198/341, 461.2, 358, 464.3

(56) References Cited

U.S. PATENT DOCUMENTS

| | | | | |
|---|---|---|---|---|
| 4,410,315 | * | 10/1983 | Frye | 493/464 |
| 4,462,287 | | 7/1984 | Weis et al. . | |
| 4,555,105 | | 11/1985 | Wyatt . | |
| 4,690,344 | * | 9/1987 | Yokota | 242/55.53 |
| 4,968,291 | * | 11/1990 | Baldacci | 493/354 |
| 4,976,600 | | 12/1990 | Willett . | |
| 5,123,889 | * | 6/1992 | Armington | 493/352 |
| 5,203,761 | * | 4/1993 | Reichental | 493/346 |
| 5,211,620 | * | 5/1993 | Ratzel | 493/346 |
| 5,292,238 | | 3/1994 | Michalak . | |
| 5,297,919 | * | 3/1994 | Reichental | 414/349 |
| 5,322,477 | * | 6/1994 | Armington et al. | 493/346 |
| 5,327,805 | * | 7/1994 | Reichental | 83/471.2 |
| 5,387,173 | * | 2/1995 | Simmons | 493/407 |
| 5,468,208 | * | 11/1995 | Armington | 493/352 |
| 5,487,717 | * | 1/1996 | Tekavec | 493/352 |
| 5,542,232 | * | 8/1996 | Beierlorzer | 53/117 |
| 5,571,067 | * | 11/1996 | Ratzel | 493/30 |
| 5,637,071 | * | 6/1997 | Simmons | 493/464 |

FOREIGN PATENT DOCUMENTS

| | | |
|---|---|---|
| 0523382 | 6/1992 | (EP) . |
| 2 624 830 | 12/1988 | (FR) . |
| WO 90/13414 | 11/1990 | (WO) . |
| WO 92/05948 | 4/1992 | (WO) . |
| WO95/13914 | 5/1995 | (WO) . |
| 9514569 | 6/1995 | (WO) . |
| WO95/28276 | 10/1995 | (WO) . |

* cited by examiner

*Primary Examiner*—Peter Vo
(74) *Attorney, Agent, or Firm*—Renner, Otto, Boisselle & Sklar, LLP

(57) ABSTRACT

A cushioning conversion machine located below a work table includes a stock supply assembly, a conversion assembly for converting the stock material into a cushioning product and providing it through a machine exit, and a pad transferring system including an upper series of rollers arranged in a path, a lower series of rollers arranged in a path and a motor for powering the rotation of the drive elements, the upper and the lower series of rollers defining a path therebetween leading from the machine exit to a passage in the work table.

15 Claims, 6 Drawing Sheets

CUSHIONING CONVERSION MACHINE

TECHNICAL FIELD

This invention relates generally to a transfer device and, more particularly, to a system for transferring a pad from a cushioning conversion machine along a curved path to a work platform for use by an operator.

BACKGROUND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and renewable, making it an environmentally responsible choice for conscientious industries. Furthermore, paper protective dunnage material is particularly advantageous for use with particle-sensitive merchandise, as its clean, dust-free surface is resistant to electrostatic buildup.

While paper in sheet form could possibly be used as a protective packaging material, it is usually preferable to convert the sheets of paper into a pad-like or other relatively low density dunnage product. This conversion may be accomplished by a cushioning conversion machine, such as those disclosed in commonly assigned U.S. Pat. Nos. 4,968,291 and 5,123,889. The therein disclosed cushioning conversion machines convert sheet-like stock material, such as paper in multi-ply form, into a pad-like dunnage product having longitudinally extending pillow-like portions that are connected together along a stitched central portion of the product. The stock material preferably consists of two or three superimposed webs or layers of biodegradable, recyclable and reusable thirty-pound Kraft paper or the like rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

Specifically, these machines convert the stock material into a continuous strip having lateral pillow-like portions separated by a thin central band. This strip is connected or coined along the central band to form a coined strip which is severed or cut into sections of a desired length. The cut sections each include lateral pillow-like portions separated by a thin central band and provide an excellent relatively low density pad-like product which may be used in place of conventional plastic protective packaging material.

As shown in U.S. patent application Ser. Nos. 08/109,124 and 08/155,931, a cushioning conversion machine may be situated below the work platform of a dispensing table. In such an arrangement, the cushioning product, or pad, travels from the generally horizontal machine through an output chute where the pad is directed upwardly to emerge through an opening in the work platform. In this manner, the pad is deposited on the work platform during operation of the machine. Consequently, an operator can conveniently grab the pad and place it in a shipping box to fill any voids and/or to cushion an item in the shipping box.

While such a device works well for a number of pads or where sufficiently long pads are being produced, if only a small number of short pads are desired, these short pads may not fully emerge from the output chute and thus cannot be conveniently retrieved by the operator.

It would be desirable for a cushioning conversion device, which is situated beneath a work platform, to deposit pads on or at the platform for use by an operator without regard to the length or number of pads produced.

SUMMARY OF THE INVENTION

The present invention provides a powered output drive system which drives a pad from a machine exit portion upwardly to a work platform. The output chute includes a number of rollers which cooperatively engage the pad as it is being produced and urge the pad upwardly toward the work platform.

In accordance with one aspect of the invention, a system for transferring a pad from a cushioning conversion machine includes an upper series of drive elements arranged in a generally arcuate path, a lower series of drive elements arranged in a generally arcuate path, and a motor for powering the rotation of the upper and lower series of drive elements, the upper and the lower series of drive elements being spaced to accommodate a pad therebetween and transfer it along a path defined by the upper and lower series of drive elements.

In accordance with another aspect of the present invention, a cushioning conversion machine, located below a work table, includes a stock supply assembly, a conversion assembly for converting the stock material into a cushioning product and providing it through a machine exit, and a cushioning product transferring system including an upper series of rollers arranged in a path, a lower series of rollers arranged in a path and a motor for powering the rotation of the rollers, the upper and the lower series of rollers defining a path therebetween leading from the machine exit to a passage in the work table.

In accordance with a further aspect of the present invention, a method of transferring a cushioning product from a cushioning conversion machine includes the steps of engaging a portion of the cushioning product between opposed drive elements and transferring the cushioning product along an at least partially curved path based on movement of the drive elements, sensing the cushioning product reaching an exit location and, after a delay adequate for the cushioning product to continue its progress past the exit location to partially emerge from the path adequate to be grasped for removal by an operator, ceasing the movement of the drive elements, and providing a signal to the cushioning conversion machine to produce a further cushioning product after the cushioning product at the exit location has been removed.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
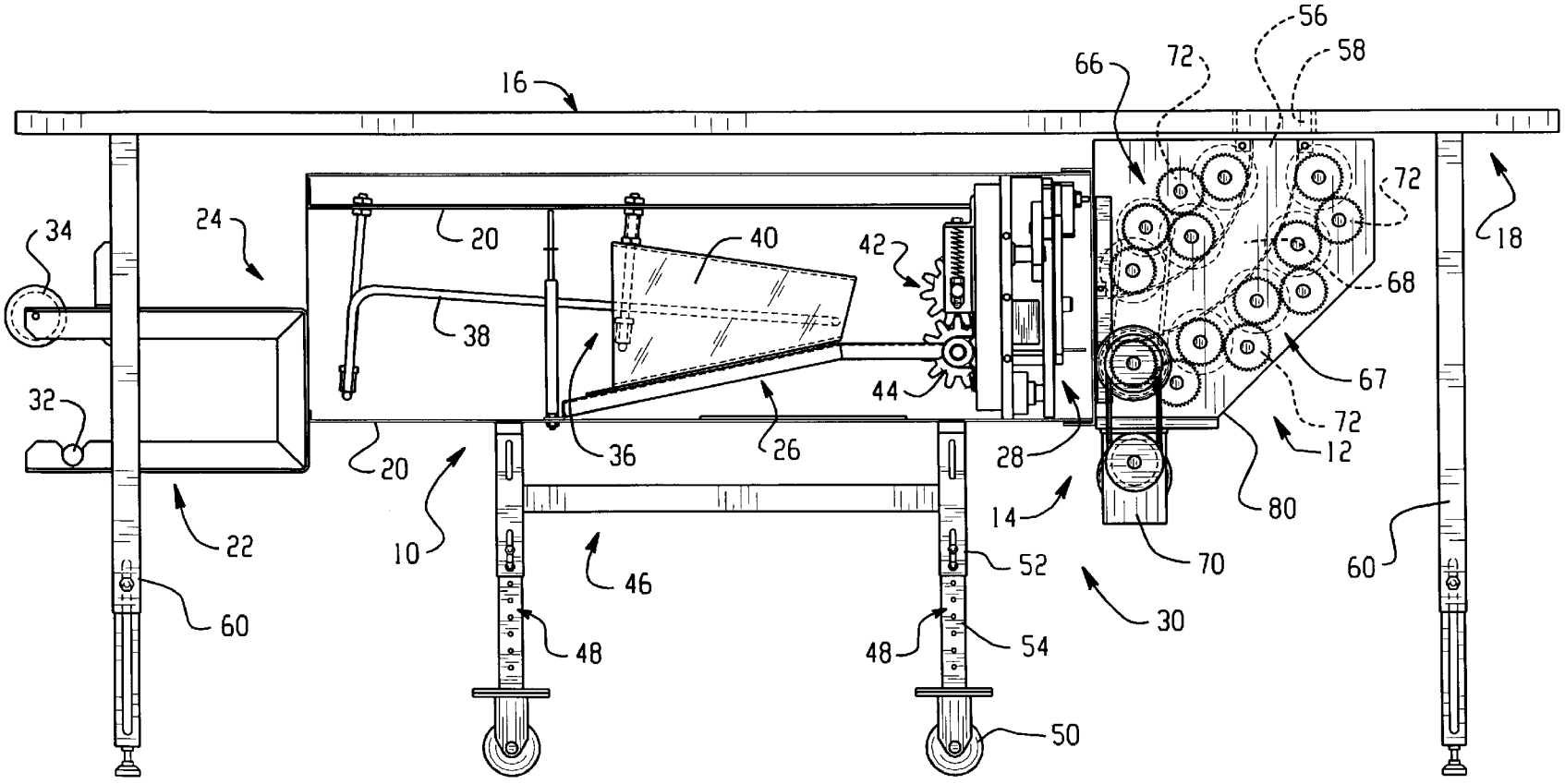
FIG. 1 is a side elevational view of a cushioning conversion machine and a curved output drive system for transferring a pad from the machine to a work platform in accordance with one embodiment of the present invention.
Figure 2:
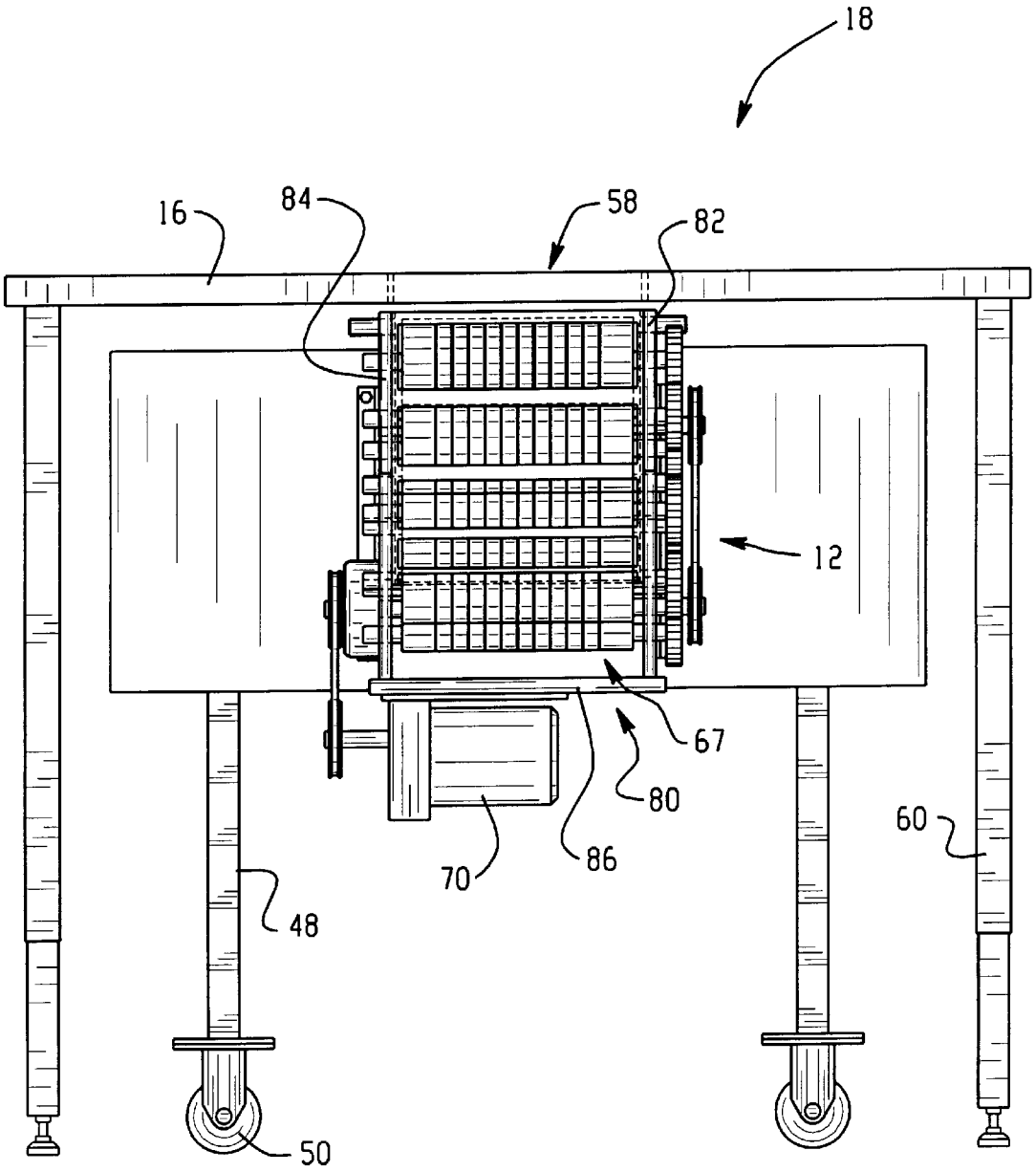
FIG. 2 is a front elevational view of the cushioning conversion machine and output drive system of FIG. 1.

Referring now to the drawings in detail and initially to FIGS. 1 and 2, there is shown a cushioning conversion machine 10 for producing low density cushioning product with a curved output drive system 12 for transferring pads upwardly from the exit 14 of the machine to a work platform 16 of a dispensing table 18.

The machine 10 includes a frame 20 to which are mounted a supply assembly 22 at the upstream end 24 of the frame for supplying stock material to be converted into a cushioning product, a conversion assembly 26 for converting the stock material into a continuous strip of cushioning product and a severing or cutting assembly 28 located generally between the conversion assembly and output drive system 12 at the downstream end 30 of the machine 10 for severing the strip into cushioning pads of the desired length. (The terms "upstream" and "downstream" in this context are characteristic of the direction of flow of the stock material through the machine 10.)

The stock supply assembly 22 preferably includes a shaft 32 for supporting a roll of sheet-like stock material (not shown) and a number of rollers 34 for providing the stock material to the conversion assembly 26. The stock material may consist of three superimposed webs of biodegradable, recyclable and reusable thirty-pound Kraft paper or the like rolled onto a hollow cylindrical tube. The conversion assembly 26 includes a forming assembly 36, such as a cooperating three dimensional wire former 38 and converging chute 40 as is shown in FIG. 1, and a feed assembly 42 including a pair of gears 44 for pulling the stock material through the forming assembly and feeding it through an outlet to the cutting assembly 28 and the curved output drive system 12. The severing or cutting assembly 28 may include one or more blades or other means acting to sever the continuous strip of padding at the appropriate times.

The machine frame 20 is supported on a cart 46 including a plurality of vertical support members or legs 48, each ending in a caster 50 to permit the machine 10 to be moved with relative ease. Preferably, the support members 48 include a fixed upper portion 52 and a telescoping lower portion 54 which moves in and out of the interior of the fixed portion to permit vertical adjustment of the machine 10 and output drive system 12 under the dispensing table 18 and accurate alignment between the exit 56 of the output drive system and the passage 58 through the work platform 16 of the dispensing table 18. Preferably the legs 60 of the dispensing table 18 are also adjustable to facilitate alignment with and more preferably a connection between the curved output drive system 12 and the dispensing table.

The output drive system 12, as discussed more fully below, forms the connection between the cushioning conversion machine 10 and the dispensing table 18 and includes a series of upper and lower rotating drive rollers 66, 67, respectively, spaced in an arc along a curved guide path 68 for engaging and transferring a pad from the machine exit 14 along the guide path and upwardly and through the passage 58 in the work platform 16 to present the formed and cut pad at or on the work platform. The upper and lower series of drive rollers 66, 67 are powered through a connection to a motor 70 and an assembly of gears 72.

During operation of the machine 10 and output drive system 12, the stock supply assembly 22 supplies the stock material to the forming assembly 36. The wire former 38 and converging conical chute 40 of the forming assembly 36 cause inward rolling of the lateral edges of the sheet-like stock material to form a continuous strip having lateral pillow-like portions. The gears 44 of the feed assembly 42 pull the stock material downstream through the machine and also coin the central band of the continuous strip to form the coined strip. As the coined strip travels downstream from the feed assembly 42 it passes through the cutting assembly 28 to the output drive system 12 where it is frictionally engaged on its opposed upper and lower surfaces by the rotating upper and lower series of drive rollers 66, 67 which transfer the pad along the guide in the direction of the work platform 16. Once a pad of the desired length has been cut by the cutting assembly 28, the series of drive rollers 66, 67 will continue to transfer the cut pad upwardly through the passage 58 in the work platform to deposit the formed and cut pad on the work platform for use as needed by the operator.

Figure 3:
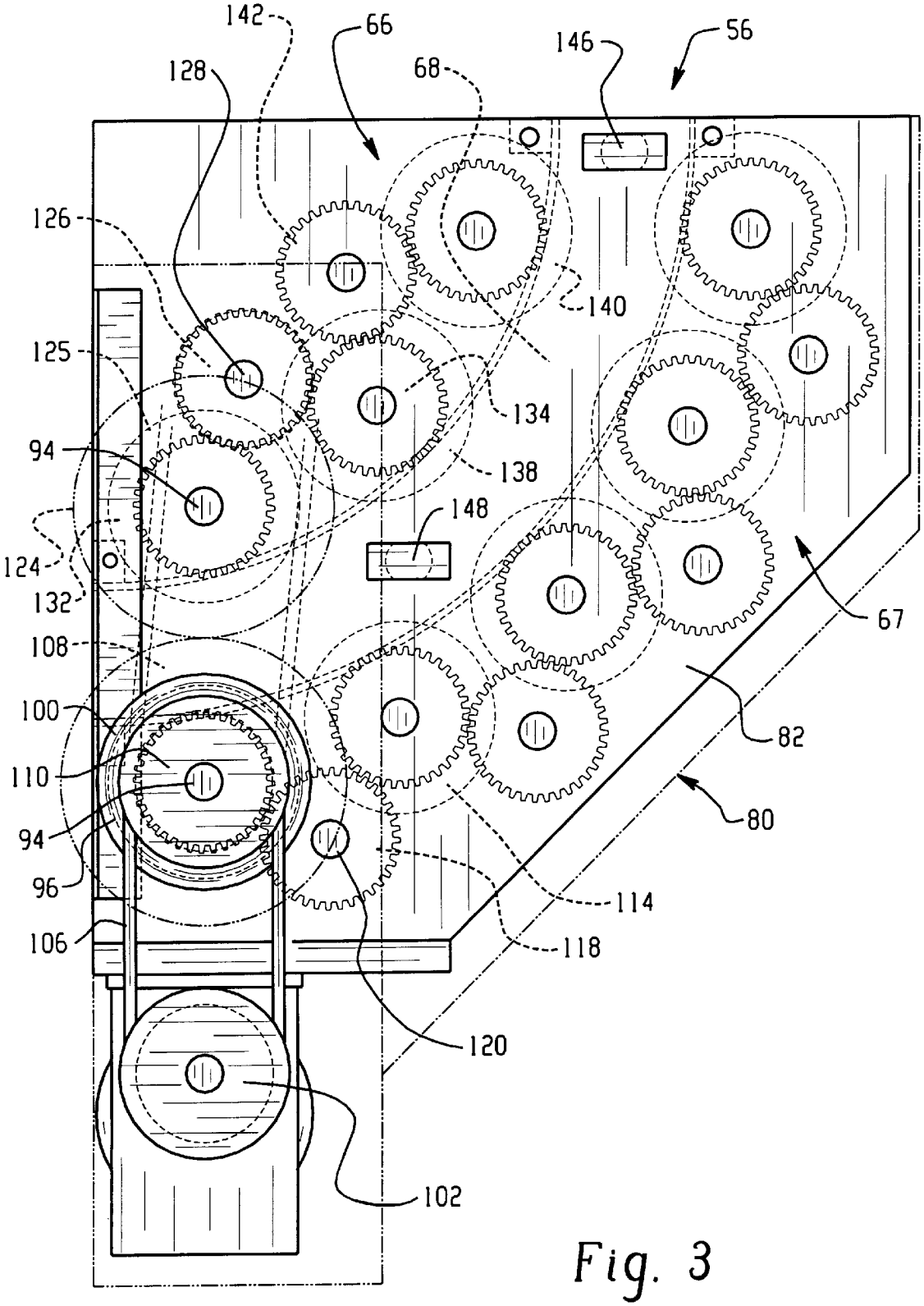
FIG. 3 is an enlarged side view of the output drive system.
Figure 4:
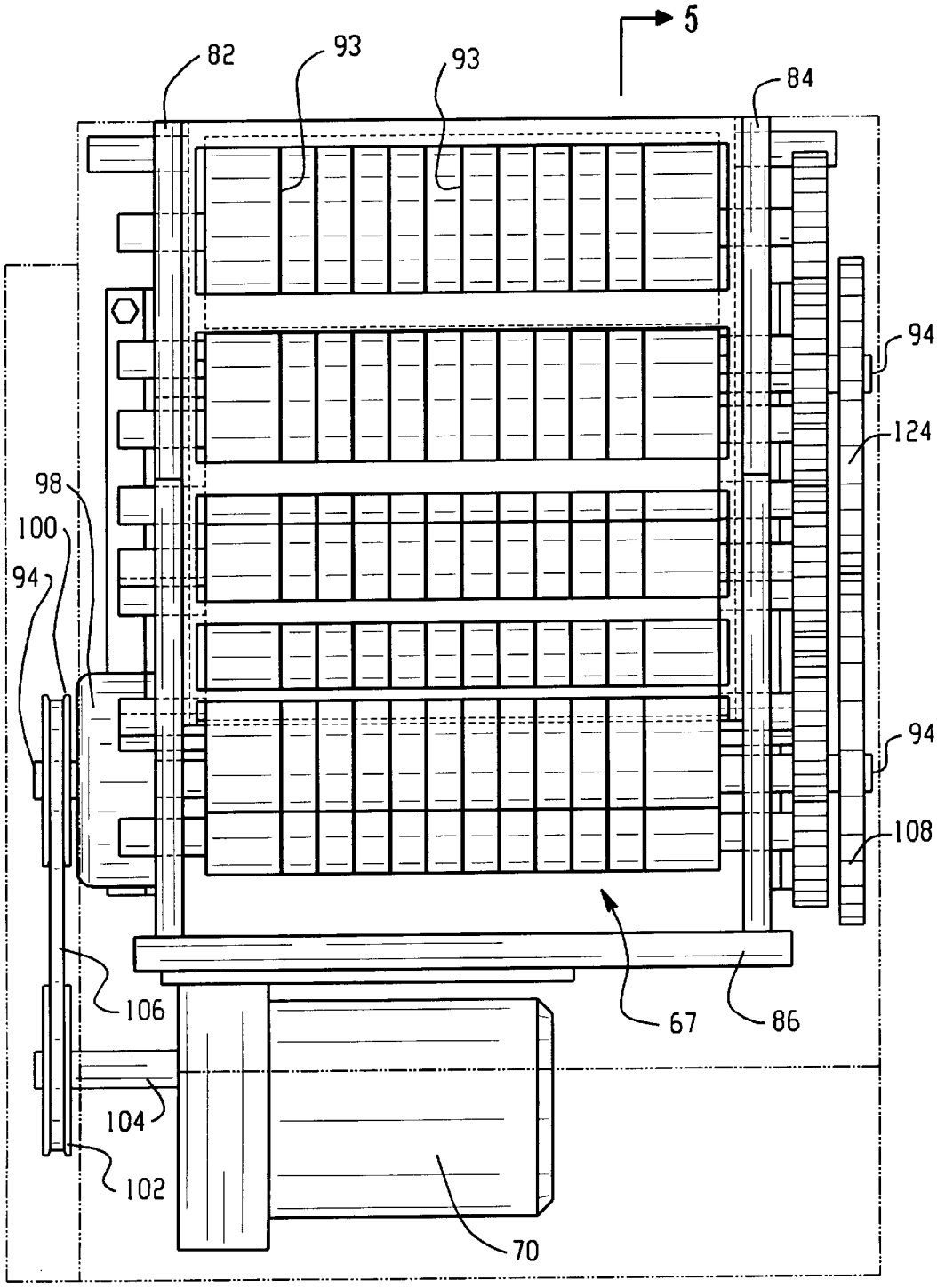
FIG. 4 is an enlarged front view of the output drive system.
Figure 5:
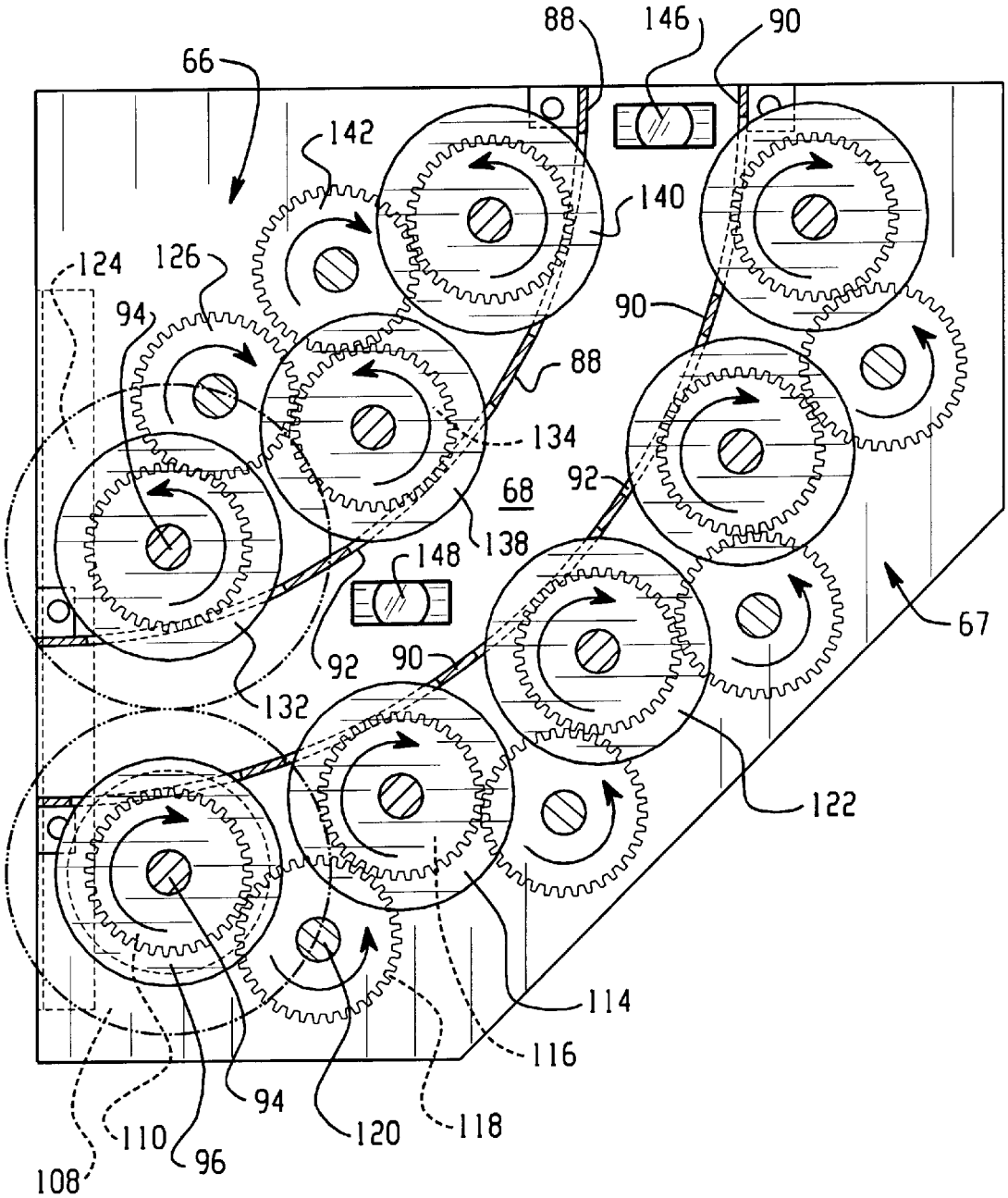
FIG. 5 is an illustration of the output drive system depicting the direction of rotation of the drive rollers.

As shown in greater detail in FIGS. 3 through 5, the curved output drive system 12 includes a frame 80 having parallel side walls 82, 84 and a bottom wall 86. Extending perpendicular to and between the side walls 82 and 84 are a pair of curved guide walls 88, 90 defining the arcuate guide path 68 therebetween. Each guide wall 88 and 90 includes a number of openings 92 through which a circumferential portion of a drive roller protrudes into the guide path 68 to engage the surface of the pad. Each drive roller of the upper and lower series of drive rollers 66, 67 extends laterally for substantially the entire distance between the side walls 82 and 84 on a shaft 94 extending through each side wall and further includes a number of axially separated circumferential channels or grooves each serving to retain an elastomeric O-ring 93 for improving the ability of a drive roller to frictionally engage a pad. The shafts 94 are positioned and the rollers are sized so that an appropriate section of each drive roller protrudes through a corresponding opening 92 in the guide walls 88 and 90 to effectively engage and transfer a pad through the guide path 68. It should be understood that the distances between the outer peripheries of the opposed upper and lower series of drive roller 66, 67 are less than the thickness of the pad passing therebetween, thereby sufficiently compressing the pad to permit the transfer thereof. The shaft 94 of the first drive roller 96 in the lower series of drive rollers 67 extends through the side wall 82 to a clutch mechanism 98 for selectively coupling the first drive roller 96 with the motor 70. Rotational motion is transferred from the motor 70 mounted to the bottom wall 86 to the first drive roller 96 through a drive pulley 102 connected to the motor shaft 104 and a belt 106 extending between the drive pulley and a pulley 100 connected to the clutch mechanism 98. Consequently, when engaged the clutch mechanism 98 transfers rotational movement from the motor 70 to the first drive roller 96 through the shaft 94. When disengaged, the clutch mechanism conversely prevents the transfer of rotational movement from the motor 70 to the first drive roller 96.

Opposite the pulley 100, a pair of gears 108 and 110 are connected to the distal end of the shaft 94 of the first drive roller 96 extending through side wall 84. The shaft 94 of the second drive roller 114 of the lower series of drive rollers 67 extends through side wall 84 for connection to a gear 116 in communication with the gear 110 of the first drive roller 96 through a transfer gear 118 rotatably mounted on a shaft 120 extending from the side wall 84. Consequently, rotation of the first drive roller 96 causes rotation of the second drive roller 114 in the same direction through common connection with the transfer gear 118. Similarly, rotational motion is transferred from drive roller 114 to the next drive roller, drive roller 122, and so on for all of the drive rollers of the lower series 67.

Rotational motion is transferred to the upper series of drive rollers 66 by an enmeshed connection between the gear 108 associated with the first drive roller 96 of the lower series of drive rollers 67 and a gear 124 adapted to drive the first drive roller 132 of the upper series of rollers 66 through the shaft 94. Rotational motion is transferred to the second drive roller 138 though a transfer gear 126 rotatably mounted on a shaft 128 extending from the side wall 84 and enmeshed with the gear 125 of the drive roller 132 and gear 134 connected to drive roller 138 through an associated shaft 94. The drive roller 138 causes rotation of the drive roller 140 through the transfer gear 142 in the same manner. Since the gear 108 transfers rotation from the first drive roller 96 of the lower series of drive rollers 67 to the drive roller 136 of the upper series of drive rollers 66 directly through the gear 124 connected to the drive roller 136, the direction of rotation of the upper series of drive rollers 66 is opposite that of the lower series of drive rollers 67 (see directional arrows in FIG. 5). Therefore, the upper and lower series of drive rollers 66, 67 will act cooperatively in urging a pad compressed therebetween in the same direction through the guide path 68, namely a direction away from the cushioning conversion machine to the dispensing table 18.

Operation of the curved output drive system 12 and assisted operation of the cushioning conversion machine 10 is accomplished through one or more sensors 146 and 148. Each of the sensors 146 and 148 may be conventional sensors for detecting the presence or absence of a pad adjacent the sensor. An example of a suitable sensor would be an optical sensor with a corresponding retro-reflector positioned at an opposite side of the path 68 from the optical sensor.

The sensor 146 is positioned near the exit portion 56 of the system 12 and senses the presence or absence of a pad at the exit portion 56. The output of the sensor 146 controls the clutch mechanism 98, preferably in combination with a timer or delay circuit (hereinafter the timer and sensor 146 are collectively referenced by the reference numeral 146), so that once a pad is sensed at the exit portion 56 by the sensor 146, transfer of the pad will continue for a short period of time, as controlled by the timer, sufficient to permit an adequate amount of pad to emerge from the passage 58 in the work platform 16 that an operator can easily access and remove the pad. Once such time has elapsed, the clutch mechanism 98 is disengaged, thereby discontinuing movement of the upper and lower series of drive rollers 66 and 67 and ceasing movement of the pad. The clutch mechanism 98 will remain disengaged until an operator removes the pad from the output drive system 12, and such removal is detected by the sensor 146. The output of the sensor 146 may also be provided to the machine 10 which can use the information to control production of pads such that when a pad is removed from the output drive system 12, as detected by the sensor 146, the machine will automatically produce another pad. The automatically produced pad will be conveyed by the output drive system 12 (as the clutch mechanism 98 is engaged since the sensor 146 is not blocked by a pad) to begin to emerge from the work platform 16 whereupon the sensor will detect the pad and the clutch mechanism 98 will be disengaged (after a short time period) and the machine will again wait for the partially emerged pad to be removed by an operator before producing another pad.

When the output of the sensor 146 is used by the machine 10 in controlling the automatic production of a pad as a pad is used by an operator, and especially when the pad length may be short, in relation to the length of the guide path 68, it is preferable to locate the sensor 148 midway between the machine exit 14 and the exit portion 56 of the output drive system 12 and to provide the output of the sensor 146 to the machine 10. As a pad progresses past the sensor 148, the sensor 148 detects the presence of the pad and reports the fact to the machine 10. The machine 10 examines the output of the sensor 148, when the sensor 146 has reported that a pad has been removed, to ensure that another pad is not already in the output drive system 12 before producing a further pad. The sensor 148 is also provided with a timer or delay circuit so that the timer 148 will continue to indicate the presence of another pad in the output drive system, even after the pad has progressed past the sensor 148 to give the pad adequate time to reach the sensor 146 located at the output. This ensures that the machine will not produce a pad when a short pad is in the output drive system, but located wholly within the "blindspot" between the sensors 146 and 148.

In some instances the motor 70 or clutch mechanism 98 may be controlled by a process controller or similar circuity in the cushioning conversion machine 10 to cause the upper and lower drive rollers 66 and 67 to operate either continuously or only while a pad is being produced and a short period thereafter adequate to transfer the pad to the dispensing table 18. The motor 70 or clutch mechanism 98 may also be controlled to pause movement of the drive rollers during a cutting operation by the cutting assembly 28. In an instance where pads are to be produced which may be of the same length or longer than the guide path 68, it is desirable that the process controller of the cushioning conversion machine cause the clutch mechanism 98 to remain engaged whenever the feed assembly 42 is operating.

Figure 6A:
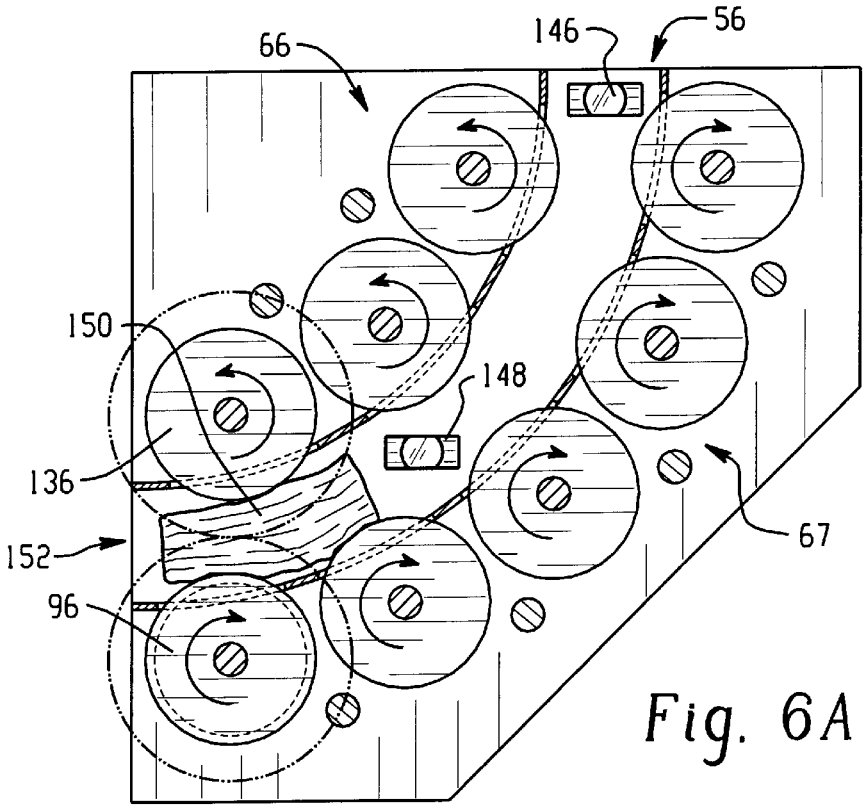
FIGS. 6A and 6B are illustrations of a pad being transferred through the output drive system.
Figure 6B:
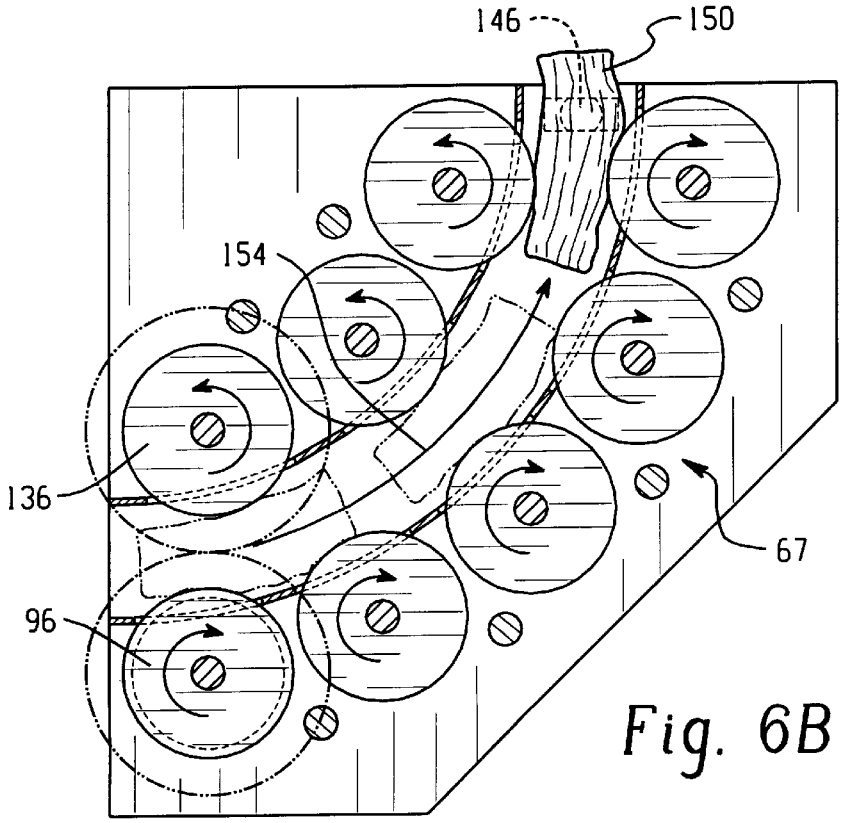

As an example of the operation of the curved output drive system 12, attention is directed to the pad 150 shown in FIGS. 6A and 6B. Once the pad 150 leaves the machine exit 14 it enters the curved output drive system 12 at entry portion 152 and is compressed and engaged by opposed drive rollers 96 and 136 (see FIG. 6A). The rotation of the drive rollers 96 and 136 causes the pad 150 to move through the guide path 68 in the direction of arrow 154 (see FIG. 6B). Continued rotation of the drive rollers in the upper and lower series of drive rollers 66, 67 moves the pad 150 further along the curved guide path 68, past the sensor 148, and causing pad 150 to pass the sensor 146. For a short period of time after the sensor 146 has detected the pad 150, as determined by the timer associated with the sensor 146, the clutch mechanism 98 will remain engaged to further drive the pad 150 to emerge from the exit port 156 for a distance sufficient to allow an operator to grasp the pad and remove it, when needed, from the output drive system 12. After that short duration, the clutch is disengaged and the pad 150 remains partially emerged from the output drive system 12 and the work platform 16 of the dispensing table 18 to present the pad to the operator at the work platform (FIG. 1).

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims. Furthermore, the corresponding structures, materials, acts, and equivalents of all means or step plus function elements in the claims below are intended to include any structure, material, or acts for performing the functions in combination with other claimed elements as specifically claimed.

What is claimed is:

1. A system for transferring a pad from a cushioning conversion machine, comprising:

an upper series of drive elements arranged in a generally arcuate path;

a lower series of drive elements arranged in a generally arcuate path; and a motor for powering the rotation of the drive elements;

the upper and the lower series of drive elements being spaced to accommodate a pad and affect the transfer thereof along a path defined by the upper and lower series of drive elements.

2. The system of claim 1, wherein the drive elements are generally cylindrical rollers.

3. The system of claim 2, wherein the rollers include a plurality of gripping elements for improving the frictional engagement between the rollers and the pad.

4. The system of claim 3, wherein the plurality of gripping elements are elastomeric O-rings disposed in circumferential grooves in the rollers.

5. The system of claim 2, further including a pair of spaced guide elements for guiding the pad therebetween, the guide elements having openings therein for a portion of the rollers to protrude therethrough for contact with the pad.

6. The system of claim 1, further including an exit portion aligned with a passage in a table for the dispensing of pads from the cushioning conversion machine through the exit portion for presentation to an operator at a top surface of the table.

7. The system of claim 1, wherein the upper and lower series of drive elements rotate in opposite directions.

8. The system of claim 1, wherein the upper and lower series of drive elements compress the pad.

9. A cushioning conversion machine located below a work table, comprising:

a stock supply assembly;

a conversion assembly for converting the stock material into a cushioning product and conveying it through a machine exit; and a cushioning product transferring system including an upper series of rollers arranged in a path; a lower series of rollers arranged in a path; and a motor for powering the rotation of the rollers; the upper and the lower series of rollers defining a predetermined path therebetween leading from the machine exit portion to a passage in the work table with the predetermined path being of a dimension to ensure frictional contact with the cushioning product.

10. The system of claim 9, wherein the rollers include a plurality of gripping elements for improving the frictional engagement between the rollers and the cushioning product.

11. The system of claim 10, wherein the gripping elements are elastomeric O-rings disposed in a circumferential direction about the rollers.

12. The system of claim 9, including a pair of spaced guide elements for guiding the cushioning product therebetween, the guide elements having openings therein for a portion of the rollers to protrude therethrough for contact with the cushioning product.

13. The system of claim 9, wherein the upper and lower series of rollers rotate in opposite directions.

14. A cushioning conversion machine comprising:

a conversion assembly which converts a stock material into a strip of cushioning;

a severing assembly, downstream of the conversion assembly, which severs the strip of cushioning into cushioning pads;

a pad-transferring system, downstream of the severing assembly, which transfers the cushioning pads away from the severing assembly, said system comprising:

an upper series of drive elements arranged in a generally arcuate path;

a lower series of drive elements arranged in a generally arcuate path; and a motor for powering the rotation of the drive elements;

the upper and the lower series of drive elements being spaced to accommodate a pad and affect the transfer thereof along a path defined by the upper and lower series of drive elements.

15. In combination, a cushioning conversion machine and a table;

the cushioning conversion machine comprising a conversion assembly which converts a stock material into a strip of cushioning, and a severing assembly, downstream of the conversion assembly, which severs the strip of cushioning into cushioning pad;

the table comprising a substantially horizontal work platform having an opening therethrough;

the cushioning conversion machine being positioned below the work platform;

the cushioning conversion machine further comprising a pad-transferring system, downstream of the severing assembly, which transfers the cushioning pads away from the severing assembly, said pad-transferring system comprising:

an upper series of rollers and a lower series of rollers defining a predetermined path therebetween leading from the severing assembly to the opening in the table's work platform; and a motor for powering the rotation of the rollers.

* * * * *